US010464346B2

(12) United States Patent
Osawa et al.

(10) Patent No.: US 10,464,346 B2
(45) Date of Patent: Nov. 5, 2019

(54) INK JET RECORDING APPARATUS

(71) Applicant: Konica Minolta, Inc., Tokyo (JP)

(72) Inventors: Satoru Osawa, Hachioji (JP); Hiroyuki Tokimatsu, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/776,866

(22) PCT Filed: Nov. 8, 2016

(86) PCT No.: PCT/JP2016/083086
§ 371 (c)(1),
(2) Date: May 17, 2018

(87) PCT Pub. No.: WO2017/086207
PCT Pub. Date: May 26, 2017

(65) Prior Publication Data

US 2018/0326758 A1 Nov. 15, 2018

(30) Foreign Application Priority Data

Nov. 20, 2015 (JP) ..... 2015-227186

(51) Int. Cl.
*B41J 11/00* (2006.01)
*B41J 13/076* (2006.01)

(52) U.S. Cl.
CPC ..... *B41J 11/0085* (2013.01); *B41J 11/002* (2013.01); *B41J 11/007* (2013.01); *B41J 13/076* (2013.01)

(58) Field of Classification Search
CPC ... B41J 11/002; B41J 11/0005; B41J 11/0085; B41J 29/38; B41J 11/007; B41J 29/393; B41J 13/076
(Continued)

(56) References Cited

U.S. PATENT DOCUMENTS

2004/0196322 A1* 10/2004 Nakajima ..... B41J 11/002 347/14
2015/0062273 A1* 3/2015 Ando ..... B41J 11/0045 347/104

FOREIGN PATENT DOCUMENTS

JP 2011020318 A * 2/2011 ..... B41J 11/002
JP 2011020318 A 2/2011
(Continued)

OTHER PUBLICATIONS

International Search Report dated Dec. 27, 2016 for PCT/JP2016/083086 and English translation.
(Continued)

*Primary Examiner* — Jannelle M Lebron
(74) *Attorney, Agent, or Firm* — Lucas & Mercanti, LLP

(57) ABSTRACT

Provided is an ink jet recording apparatus capable of easily and more reliably performing fixation processing on a recording medium moved after image recording. The ink jet recording apparatus is provided with: an image forming unit (12) that ejects ink; a first conveyance unit (11) that conveys a recording medium (P) on which the ejected ink is to land and relatively moves the same with respect to the image forming unit; a fixation unit (24) that fixes the ink that has landed on the recording medium; a second conveyance unit (21) that conveys the recording medium on which the ink to be fixed has landed and relatively moves the same with respect to the fixation unit; and a first end pressing roller (215) and a second end pressing roller (216) which serve as a floating suppression unit that suppresses, from the ink-landed surface side, floating of the recording medium from a recording medium conveyance surface in the second conveyance unit. The floating suppression unit suppresses the floating of the recording medium in a suppression range that can be changed and set so as not to include a recording
(Continued)

width range in which the image forming unit causes the ink to land on the recording medium.

12 Claims, 6 Drawing Sheets

(58) Field of Classification Search
USPC ..... 347/14, 16, 19, 101, 102, 104, 105
See application file for complete search history.

(56) References Cited

FOREIGN PATENT DOCUMENTS

| | | | | |
|---|---|---|---|---|
| JP | 2015036335 | A | | 2/2015 |
| JP | 2015048181 | A | | 3/2015 |
| JP | 2015058571 | A | * | 3/2015 |
| JP | 2015058571 | A | | 3/2015 |

OTHER PUBLICATIONS

Office Action dated Mar. 19, 2019 for counterpart Chinese Patent Application No. 201680067636.5 and English translation.
International Preliminary Report on Patentability dated Dec. 27, 2016 from the corresponding International Application No. PCT/JP2016/083086 and English translation.

* cited by examiner

INK JET RECORDING APPARATUS

CROSS REFERENCE TO RELATED APPLICATION

This Application is a 371 of PCT/JP2016/083086 filed on Nov. 8, 2016, which, in turn, claimed the priority of Japanese Patent Application No. JP 2015-227186 filed on Nov. 20, 2015, both applications are incorporated herein by reference.

TECHNICAL FIELD

The present invention relates to an ink jet recording apparatus.

BACKGROUND ART

There have been conventionally ink jet recording apparatuses which record images by ejecting ink from nozzles and causing the ink to land at desired positions on recording media. Various inks are used for such ink jet recording apparatuses in order to accurately record images on various recording media. Some ink jet recording apparatuses apply processing liquid to recording media or perform processing for surely fixing the ink which landed on the recording media.

As one of the inks used in such ink jet recording apparatuses, there is a UV curable ink which is hardened by emission of ultraviolet rays (UV light). The ink jet recording apparatuses using such an ink can rapidly and firmly fix the ink onto the recording media by emitting UV light to the recording media after ejecting and landing the ink onto the recording media.

It is desirable that the recording media and the ink are maintained within an appropriate temperature range when the ink lands on the recording media, in order to appropriately control the spread and permeation degrees and the like of the ink onto the recording media. However, the conventional ink jet recording apparatuses have had a problem that, when processing operations such as ink ejection, drying and fixing are performed on a same conveyance surface, influences of movements of drying and fixing configurations, ink reaction heat and the like transmit via the conveyance surface to the recording medium before image recording, leading to an inappropriate temperature of the recording medium. Patent Document 1 discloses an ink jet recording apparatus which has a sucking adhesion mechanism provided on the outer circumferential surface of a conveyance drum that rotates with a recording medium placed on the outer circumferential surface, performs image recording while maintaining the recording medium at an appropriate position by sucking air, and performs drying and fixing operations on a surface different from the conveyance drum by performing drying and emitting UV light while grasping, with a chain gripper, an end of the recording medium on which image recording was performed and moving the recording medium on the horizontal conveyance surface where the sucking adhesion operation is being performed.

PRIOR ART DOCUMENT

Patent Document

Patent Document 1: Japanese Patent Application Laid Open Publication No. 2015-36335

DISCLOSURE OF THE INVENTION

Problems to be Solved by the Invention

However, there is a case where, when the fixing operation is performed by once removing the recording medium after image recording from the conveyance surface and moving the recording medium to the other conveyance surface, the recording medium is not normally placed on the conveyance surface due to curvature of the recording medium or the like and problems occur in quality of the fixing processing.

An object of the present invention is to provide an ink jet recording apparatus that can easily and surely perform fixing processing to a recording medium which was moved after image recording.

Means for Solving the Problem

In order to achieve the above object, the invention described in claim 1 is an ink jet recording apparatus, including: an image recorder that is provided with a nozzle which ejects ink; a first conveyer that conveys a recording medium, on which the ejected ink is to land, to move the recording medium relative to the image recorder; a fixer that fixes the ink which lands on the recording medium onto the recording medium; a second conveyer that conveys the recording medium, on which the ink to be fixed lands, to move the recording medium relative to the fixer; and a floating suppresser that suppresses, from an ink-landed surface side, floating of the recording medium from a conveyance surface on which the recording medium is placed in the second conveyer, wherein the floating suppresser suppresses the floating of the recording medium in a suppression range that is able to be changed and set not to include a recording width range in a width direction orthogonal to a conveyance direction of the recording medium by the second conveyer in the conveyance surface, the recording width range being a range in which the image recorder causes the ink to land on the recording medium.

The invention described in claim 2 is the ink jet recording apparatus according to claim 1, further including a sucker that causes the recording medium, for which the floating from the conveyance surface is suppressed, to adhere to the conveyance surface of the second conveyer by suction.

The invention described in claim 3 is the ink jet recording apparatus according to claim 2, wherein the floating suppresser is provided in such a manner that at least a part of each of the suppression range is included between a suction start position by the sucker and a fixing start position by the fixer in the conveyance direction.

The invention described in claim 4 is the ink jet recording apparatus according to any one of claims 1 to 3, further including a suppression controller that controls setting of the suppression range by the floating suppresser, wherein the second conveyer conveys the recording medium by placing the recording medium at a position corresponding to a size in the width direction of the recording medium, and the suppression controller determines the suppression range not to include the recording width range.

The invention described in claim 5 is the ink jet recording apparatus according to claim 4, wherein the floating suppresser has a suppressing member that suppresses the floating of the recording medium in the suppression range corresponding to the size in the width direction which is determined in advance, a number of the suppression member corresponding to a plurality of different sizes in the width direction, and the suppression controller selectively arranges the suppression member corresponding to the size in the width direction which is obtained at a position corresponding to the suppression range to suppress the floating of the recording medium.

The invention described in claim 6 is the ink jet recording apparatus according to claim 4 or 5, further including an operation receiver that receives user operation, wherein the operation receiver is able to receive setting of the size in the width direction.

The invention described in claim 7 is the ink jet recording apparatus according to any one of claims 1 to 6, wherein the floating suppresser presses the recording medium against the conveyance surface.

The invention described in claim 8 is the ink jet recording apparatus according to claim 7, wherein the floating suppresser has a roller member that is provided to be rotatable around a rotation shaft which is parallel to the width direction.

The invention described in claim 9 is the ink jet recording apparatus according to any one of claims 1 to 8, wherein the image recorder ejects ink to be hardened by predetermined energy rays, and the fixer has an emitter that emits the predetermined energy rays to the ink which lands on the recording medium.

The invention described in claim 10 is the ink jet recording apparatus according to any one of claims 1 to 9, further including a temperature adjuster that maintains a temperature of a conveyance surface of the first conveyer within a predetermined temperature range.

The invention described in claim 11 is the ink jet recording apparatus according to any one of claims 1 to 10, further comprising a reader that reads a landing surface of the recording medium on which the ink lands on a conveyance surface of the first conveyer.

Effects of the Invention

According to the present invention, there is an effect that the ink jet recording apparatus can easily and more surely perform fixing processing to the recording medium which was moved after image recording.

EMBODIMENTS FOR CARRYING OUT THE INVENTION

Hereinafter, an embodiment of the present invention will be described on the basis of the drawings.

Figure 1:
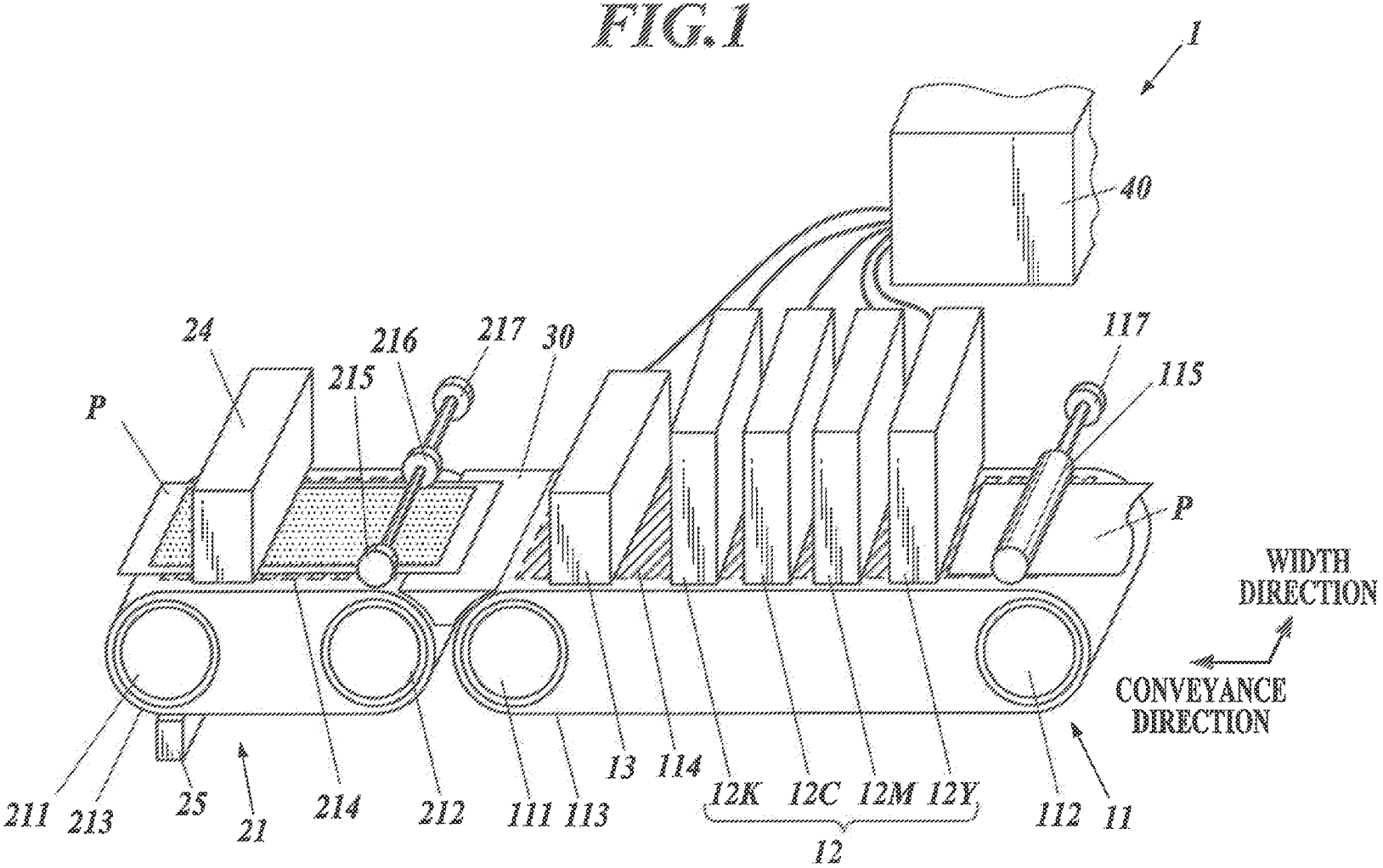
FIG. 1 This is a schematic diagram showing an ink jet recording apparatus in an embodiment of the present invention.

FIG. 1 is a schematic view showing the entire configuration of an ink jet recording apparatus 1 in the embodiment.

The ink jet recording apparatus 1 is a single pass system having line heads, and includes a first conveyor 11, an image former 12 (image recorder), a reader 13, a second conveyer 21, a fixer 24, a cooler 25, a deliverer 30, a controller 40 and the like.

The first conveyer 11 receives a recording medium P which was supplied from a medium supplier that is not shown in the drawings, places the recording medium P on the outer lateral surface of a first conveyance belt 113, and moves (moves relative to the nozzle surfaces) the recording medium P while making the recording medium P face the nozzle surfaces of the image former 12. The first conveyer 11 includes a first drive roller 111, a first following roller 112, the first conveyance belt 113, a first sucker 114, a pressing roller 115, a first pressing motor 117 and the like.

Figure 2:
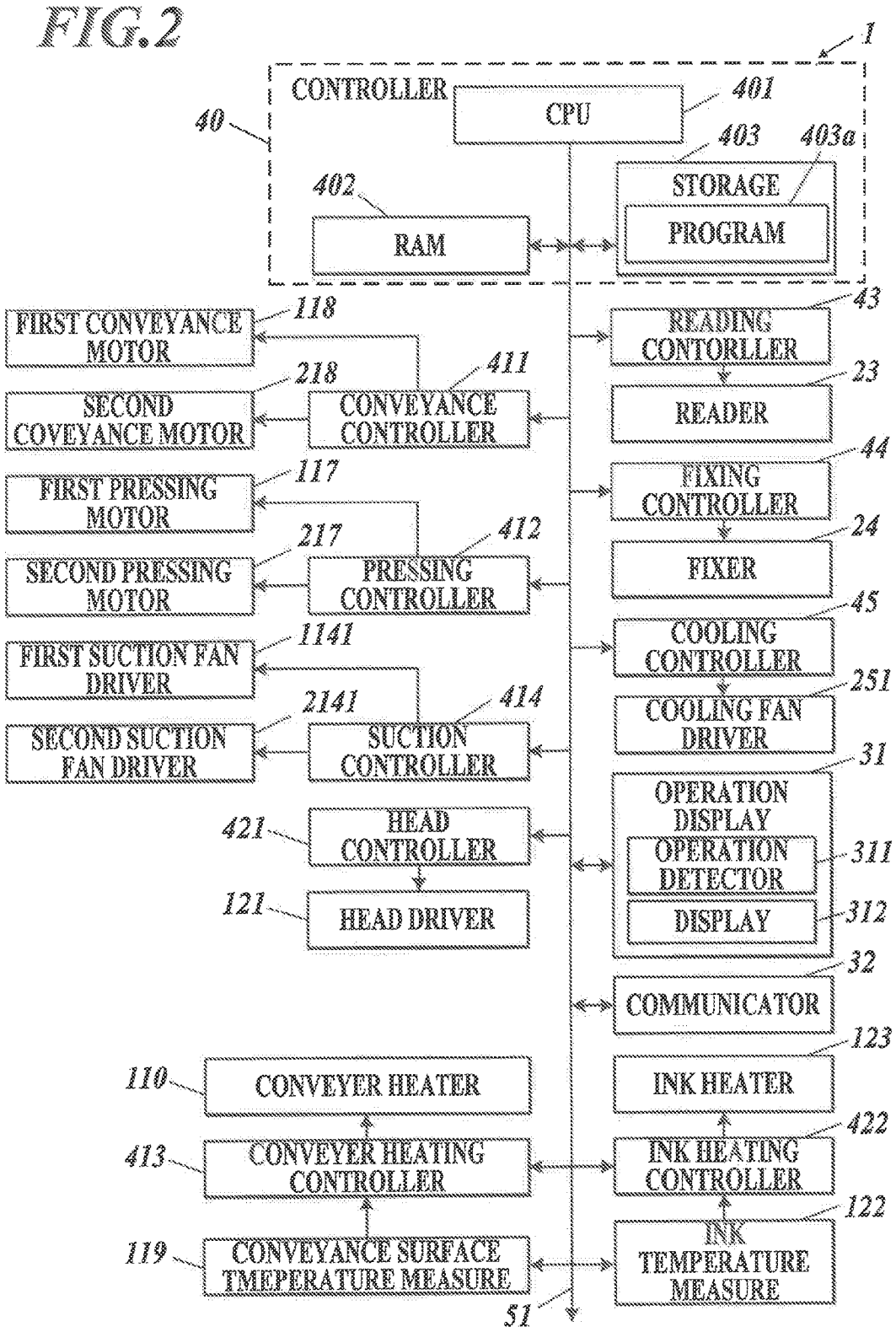
FIG. 2 This is a block diagram showing the functional configuration of the ink jet recording apparatus.

The first drive roller 111 is rotated at a rotation speed corresponding to the rotation operation of the first conveyance motor 118 (see FIG. 2).

The first conveyance belt 113 is an endless belt having the inner lateral surface supported by the first drive roller 111 and the first following roller 112, and moves the recording medium P placed on the outer lateral surface (conveyance surface) by rotary movement according to the rotation of the first drive roller 111 and the first following roller 112. Here, the first conveyance belt 113 has a structure or a material allowing air to go through by providing a plurality of holes or the like, and the recording medium P which is placed on the outer lateral surface is sucked to be fixed by the sucking operation of the first sucker 114 making air flow from the outer lateral surface side to the inner lateral surface side.

The first sucker 114 sucks the recording medium P which is placed on the outer lateral surface of the first conveyance belt 113. Here, the first sucker 114 includes a first suction fan and a first suction fan driver 1141 (see FIG. 2) which rotates the first suction fan, and sucks air from the outer lateral surface side by ejecting air to the inner lateral surface side of the first conveyance belt 113. Alternatively, the first sucker 114 may have other configurations, for example, a configuration of generating static electricity or the like to temporarily make the recording medium P stick to the outer lateral surface of the first conveyance belt 113.

The pressing roller 115 presses the recording medium P supplied from the medium supplier against the outer lateral surface of the first conveyance belt 113. By this operation of the pressing roller 115, wrinkles, loosing, curling-up and the like of the recording medium P are solved, and the entire recording medium P can be more surely fixed on the outer lateral surface of the first conveyance belt 113 in accordance with the sucking operation of the first sucker 114. The pressing roller 115 extends across the maximum width or more of the recording medium Pin the width direction orthogonal to the conveyance direction of the recording medium P, and presses the entire surface of the recording medium P in combination with the conveyance movement of the recording medium P.

The first pressing motor 117 causes the pressing roller 115 to perform pressing operation. The first pressing motor 117 can cause the pressing roller 115 to perform rotation operation so that the contact surface rotates at a speed equal to the rotary movement speed of the first conveyance belt 113. The first pressing motor 117 performs operation of moving the pressing roller 115 in a direction (vertical direction) changing the distance from the outer lateral surface of the first conveyance belt 113, and maintains an appropriate pressure according to the thickness of the recording medium P or the like. In this ink jet recording apparatus 1, the first pressing motor 117 can also raise the pressing roller 115 to a position where the pressing roller 115 is completely separated from the recording medium P.

On the upstream side in the conveyance direction of the pressing roller 115, there may be provided a guide member which reduces floating of the head (most downstream side) of the recording medium P and directs the head toward the first conveyance belt 113. In a case where the head (most downstream side) of the recording medium P floats, the recording medium P possibly gets caught on the pressing roller 115 to generate a jam of the recording medium P, and thus, the guide member can prevent this.

This ink jet recording apparatus 1 can convey the recording medium P of a plurality of sizes (widths) in a range of equal to or less than a maximum width, which was determined as conveyable by the first conveyer 11 in advance, by placing the recording medium P at an appropriate position in the width direction.

The image former 12 includes head units 12C, 12M, 12Y and 12K which are provided with nozzles ejecting inks of a plurality of colors (here, four colors of C, M, Y and K). The head units 12C, 12M, 12Y and 12K are arranged in order in a conveyance direction so that the nozzle surfaces, on which the openings of the nozzles are provided, face the outer lateral surface of the first conveyance belt 113. The head units 12C, 12M, 12Y and 12K receive ink supply from ink tanks which are not shown in the drawings and pooling the respective corresponding inks, and eject inks from the nozzles at appropriate timings according to the control signals from the controller 40. The head units 12C, 12Y, 12M and 12K here have line heads in which the plurality of nozzle openings are respectively provided over the entire recordable width of the recording medium P at predetermined intervals in the width direction. The plurality of nozzle openings provided in one head unit may be arranged to be distributed at a plurality of positions which are different in the conveyance direction.

Here, the ejected ink is UV curable ink, and changes between a sol state and a gel state according to the temperature. Accordingly, the image former 12 is provided with an ink heater 123 (see FIG. 2) which maintains the ink temperature be an appropriate temperature for keeping the sol state. The ink jet recording apparatus 1 further includes a conveyer heater 110 (see FIG. 2) which performs heating and temperature retaining of the first conveyance belt 113 and the recording medium before landing of the ink ejected from the nozzles.

The reader 13 captures, on the outer lateral surface (conveyance surface) of the first conveyance belt 113, the image of the surface of the recording medium P on which the ink ejected by the image former 12 landed, and outputs the image capturing data to the controller 40. The reader 13 includes a line sensor, and can two-dimensionally read the recording medium P by capturing the image of the surface of the recording medium P moving in the conveyance direction with an appropriate cycle corresponding to the movement speed (conveyance speed) of the recording medium P.

The deliverer 30 obtains the recording medium P after image recording from the first conveyer 11 and transmits the recording medium P to the second conveyer 21. The deliverer 30 may have a blade-like structure for simply removing the recording medium P from the first conveyance belt 113, or may have a claw (gripper) or the like which grasps the end of the recording medium P at the movement timing and transmits the recording medium P to the second conveyer 21.

The second conveyer 21 coveys the recording medium P, which was delivered via the deliverer 30 from the first conveyer 11, while maintaining the state in which the image recording surface (ink-landed surface) of the recording medium P can be fixed by the fixer 24, to move the recording medium P relative to the fixer 24, and the second conveyer 21 ejects the recording medium P after fixing to a medium ejector which is not shown in the drawings. The second conveyer 21 includes a second drive roller 211, a second following roller 212, a second conveyance belt 213, a second sucker 214 (sucker), a first end pressing roller 215, a second end pressing roller 216, a second pressing motor 217 and the like.

The second drive roller 211 is rotated at a rotation speed corresponding to the rotation operation of the second conveyance motor 218 (see FIG. 2).

The second conveyance belt 213 is an endless belt having the inner lateral surface supported by the second drive roller 211 and the second following roller 212, and moves the recording medium P placed on the outer lateral surface (conveyance surface) by rotary movement according to the rotation of the second drive roller 211 and the second following roller 212. Here, the second conveyance belt 213 has a structure or a material allowing air to go through by a plurality of holes or the like, and the recording medium P which is placed on the outer lateral surface is sucked to be fixed to the outer lateral surface by the sucking operation of the second sucker 214 making air flow from the outer lateral surface side to the inner lateral surface side.

The second sucker 214 sucks the recording medium P which is placed on the outer lateral surface of the second conveyance belt 213. Here, the second sucker 214 includes a second suction fan which ejects air and a second suction fan driver 2141 (see FIG. 2) which rotates the second suction fan, and sucks air from the outer lateral surface side by ejecting air to the inner lateral surface side of the second conveyance belt 213. Alternatively, the second sucker 214 may have other configurations, for example, a configuration of generating static electricity or the like to temporarily make the recording medium P stick to the outer lateral surface of the second conveyance belt 213.

The first end pressing roller 215 and the second end pressing roller 216 (which are collectively referred to as suppressing members or roller members) are provided to be rotatable around the rotation shaft extending in the width direction which is orthogonal to the conveyance direction of the recording medium P in the conveyance surface of the recording medium P by the outer lateral surface of the second conveyance belt 213, presses the both ends in the width direction of the recording medium P delivered by the deliverer 30 against the outer lateral surface of the second conveyance belt 213, and thereby suppresses the floating of the recording medium P from the second conveyance belt 213. By this operation of the first end pressing roller 215 and the second end pressing roller 216, curling-up and the like of the recording medium P are solved, and the entire recording medium P can be more surely fixed on the outer lateral surface of the second conveyance belt 213 in accordance with the sucking operation of the second sucker 214. The first end pressing roller 215 and the second end pressing roller 216 are configured so that the positions thereof (suppression ranges) in the width direction can be changed and set independently or in conjunction with each other. It is preferable that the positions to press the recording medium P by the first end pressing roller 215 and the second end pressing roller 216 are between the suction start position (suction start position) by the second sucker 214 and the position (fixing start position) which is included in the emission range of the ultraviolet rays by the fixer 24 in the conveyance direction.

The second pressing motor 217 causes the first end pressing roller 215 and the second end pressing roller 216 to perform pressing operation. The second pressing motor 217 can perform operation of moving the first end pressing roller 215 and the second end pressing roller 216 in a direction (vertical direction) changing the distance from the outer lateral surface of the second conveyance belt 213, to maintain an appropriate pressure according to the thickness of the recording medium P or the like or raise the first end pressing roller 215 and the second end pressing roller 216 to positions where the first end pressing roller 215 and the second end pressing roller 216 are completely separated from the recording medium P. The second pressing motor 217 can also change the positions in the width direction of the first end pressing roller 215 and the second end pressing roller 216 as described above. Furthermore, the second pressing motor 217 may be able to cause the first end pressing roller 215 and the second end pressing roller 216 to perform the rotation operation so that the roller surfaces rotate at a speed equal to the rotary movement speed of the second conveyance belt 213.

A floating suppresser is configured by including the first end pressing roller 215, the second end pressing roller 216 and the second pressing motor 217.

The fixer 24 emits energy rays of a predetermined wavelength, here, ultraviolet rays (UV light), and hardens the ink which was ejected onto the recording medium P by the image former 12 and landed on the recording medium P. The fixer 24 has a light emitting diode (LED) (emitter) which emits UV light, for example, and emits UV light by light emission at an appropriate intensity by applying a voltage to the LED to make current flow. The fixer 24 is arranged to be close to the outer lateral surface of the second conveyance belt 213 so that the UV light is emitted to the ink on the recording medium P in the range where the recording medium P is placed on the second conveyance belt 213 of the second conveyer 21 and sucked by the second sucker 214.

The cooler 25 cools the second conveyance belt 213 within the range where the recording medium P is not placed on the outer lateral surface of the second conveyance belt 213 in the second conveyer 21. The cooler 25 includes, for example, a cooling fan, and blows air to the second conveyance belt 213 to perform air cooling of the second conveyance belt 213 which had the temperature raised due to the radiation heat by the light emitting diode of the fixer 24 and the reaction heat according to the ink fixing by the UV light. The cooler 25 may include the configuration of supplying cold air and external air to the cooling fan.

The controller 40 controls the operations of the components of the ink jet recording apparatus 1 to record an image on the recording medium P according to settings for data of the recording target image and image recording by the image recording instruction (job).

FIG. 2 is a block diagram showing the functional configuration of an ink jet recording apparatus 1 in the embodiment.

The ink jet recording apparatus 1 includes the controller 40, the conveyance controller 411, the first conveyance motor 118 and the second conveyance motor 218, the pressing controller 412 (suppression controller), the first pressing motor 117 and the second pressing motor 217, the suction controller 414, the first suction fan driver 1141 and the second suction fan driver 2141, the head controller 421 and the head driver 121, the conveyer heating controller 413, the conveyance surface temperature measure 119 and the conveyer heater 110 (temperature adjuster), the ink heating controller 422, the ink temperature measure 122 and the ink heater 123, the reading controller 43 and the reader 13, the fixing controller 44 and the fixer 24, the cooling controller 45 and the cooling fan driver 251, the operation display 31, the communicator 32 and the like.

Among them, the conveyance controller 411, the pressing controller 412, the suction controller 414, the head controller 421, the conveyer heating controller 413, the ink heating controller 422, the reading controller 43, the fixing controller 44 and the cooling controller 45 are collectively referred to as individual operation controllers. For these individual operation controllers, respective hardware configurations in the controller 40 may be used, or dedicated CPUs, memories, logical circuits and the like may be separately prepared.

The controller 40 has a CPU (Central Processing Unit) 401, a RAM (Random Access Memory) 402, a storage 403 and the like. The controller 40 temporarily stores the program 403*a* for controlling and setting data read from the storage 403 in the RAM 402, and the CPU 401 performs control processing on the basis of the temporarily stored data. The storage 403 has an auxiliary storage such as a nonvolatile memory or an HDD (Hard Disk Drive) capable of repeated reading and writing. An ROM only capable of reading may be used for a part of the storage 403.

The controller 40 (CPU 401) integrally controls the operation of the ink jet recording apparatus 1. The controller 40 controls the operations of the components in the ink jet recording apparatus 1 via the individual operation controllers on the basis of the instruction regarding image recording and the recording image data, that is, a print job, obtained from outside via the communicator 32.

The operation display 31 receives user operation and performs displaying for indicating status information, operation menu and the like to a user. The operation display 31 has an operation detector 311 as an operation receiver and a display 312. The display 312 includes a display screen, for example, an LCD (liquid crystal display), and causes the LCD to perform various types of displaying according to the control signals from the controller 40. The operation detector 311 includes a touch sensor which is arranged to be superposed on the LCD, for example, and the operation detector 311 detects the operation at the position coordinate corresponding to the display position of the LCD and outputs the detection signal to the controller 40.

The communicator 32 is an interface which performs communication connection with an external device such as a PC and performs data communication in accordance with various types of communication standards. As the communicator 32, there is, for example, a network card for LAN connection, a wireless communication interface using Bluetooth communication (registered trademark: Bluetooth) and the like. The communicator 32 may be a connection terminal or a driver for direct connection with an external device by a USB. The controller 40 obtains the print job, various types of control setting data of the ink jet recording apparatus 1 and the like from the external device via the communicator 32.

The head driver 121 supplies electric power at appropriate timings to the loads provided in the respective head units 12Y, 12M, 12C and 12K (such as piezoelectric elements in a piezo-type ink jet recording apparatus or heating elements in a thermal-type ink jet recording apparatus) according to the control signal from the head controller 421 and the image data of the recording target, and ejects ink from the openings of the respective nozzles.

The cooling fan driver 251 rotates the cooling fan of the cooler 25 at an appropriate rotation speed on the basis of the control by the cooling controller 45.

The first suction fan driver 1141 rotates the first suction fan of the first sucker 114 at an appropriate rotation speed on the basis of the control by the suction controller 414.

The second suction fan driver 2141 rotates the second suction fan of the second sucker 214 at an appropriate rotation speed on the basis of the control by the suction controller 414.

The conveyer heater 110 heats the conveyance surface of the first conveyer 11 so that the recording medium P is within an appropriate temperature range at the time of ink landing on the basis of the control by the conveyer heating controller 413. On the basis of control by the ink heating controller 422, the ink heater 123 heats the ink flow path and the surrounding members so that the ink supplied to the respective head units 12Y, 12M, 12C and 12K from ink tanks does not become a gel inside the ink flow path until ejection from the nozzle openings and an appropriate temperature is maintained.

The conveyance surface temperature measure 119 and the ink temperature measure 122 respectively measure the surface temperature of the first conveyance belt 113 or of the recording medium P placed on the first conveyance belt 113, and the temperature of the ink flow path or of the ink in the ink flow path in order to appropriately maintain the heating state by the conveyer heater 110 and the ink heater 123, and output the respective measurement results to the conveyer heating controller 413 and the ink heating controller 422.

The conveyance surface temperature measure 119 and the conveyer heating controller 413 may be included in the temperature adjuster.

The conveyance controller 411 controls the operations of the first conveyance motor 118 and the second conveyance motor 218 to convey the recording medium P at appropriate speeds, and to perform image recording operation and the fixing operation, respectively.

The pressing controller 412 controls the operations of the first pressing motor 117 and the second pressing motor 217 to place the recording medium P on the respective outer lateral surfaces of the first conveyance belt 113 of the first conveyer 11 and the second conveyance belt 213 of the second conveyer 21 while suppressing wrinkles and floating.

The reading controller 43 controls the operation of the reader 13 to capture a recorded image at an appropriate position according to the conveyance timing and speed of the recording medium P.

The fixing controller 44 controls the operation of the fixer 24 to fix the ink of the image recorded on the recording medium P.

Next, the image recording operation and the fixing operation on the recording medium P in the ink jet recording apparatus 1 in the embodiment will be described.

In the ink jet recording apparatus 1 in the embodiment, the recording medium P is first conveyed by the first conveyer 11 while an image is recorded thereon, and next delivered to the second conveyer 21, which conveys the recording medium P while the ink on the recording medium P used for the image recording is fixed and hardened.

When the recording medium P is delivered to the separate first conveyer 11 and the second conveyer 21, as described above, in the first conveyer 11, the wrinkles, warp and the like on the entire recording medium P are stretched by the pressing roller 115, and the recording medium P adheres to the outer lateral surface of the first conveyance belt 113 by suction to be held thereon according to the operation of the first sucker 114.

On the other hand, in the second conveyer 21, since there is delivered the recording medium P on which the ink landed but is not yet fixed, there is a possibility that the recorded image becomes deteriorated and the surface of the pressing roller becomes dirty if the entire surface of the recording medium P is pressed. Thus, in the second conveyer 21, only the image non-recorded areas on the both ends in the width direction are pressed by the first end pressing roller 215 and the second end pressing roller 216, thereby the warp and the like are stretched without deterioration of the image, and the recording medium P adheres to the outer lateral surface of the second conveyance belt 213 by suction to be held thereon according to the operation of the second sucker 214.

As described above, in the ink jet recoding apparatus 1, the recording media of a plurality of widths can be conveyed, and the positions of the first end pressing roller 215 and the second end pressing roller 216 are changed according to the width of the conveyed recording medium. As the changing operation, there are assumed a case where the pressing controller 412 drives the second pressing motor 217 according to the size information of the recording medium which was set in the print job, and a case where the pressing controller 412 drives the second pressing motor 217 according to the size information (size in the width direction) of the recording medium which was manually input via the operation display 31 by the user. There may be also included a case where the user manually moves the positions of the first end pressing roller 215 and the second end pressing roller 216 according to the size information of the recording medium.

Figure 3A:
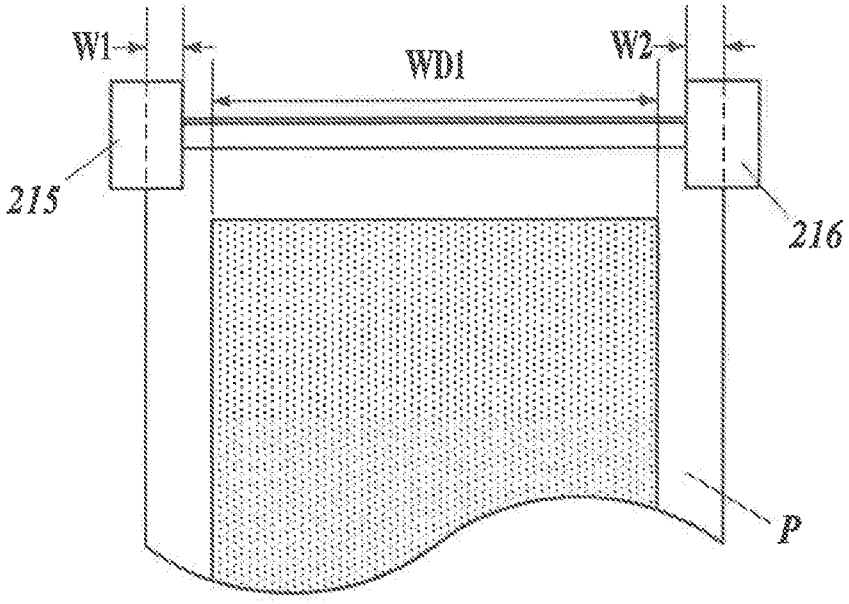
FIG. 3A This is a view for explaining the positional relationship between a recording medium and a first end pressing roller and a second end pressing roller.
Figure 3B:
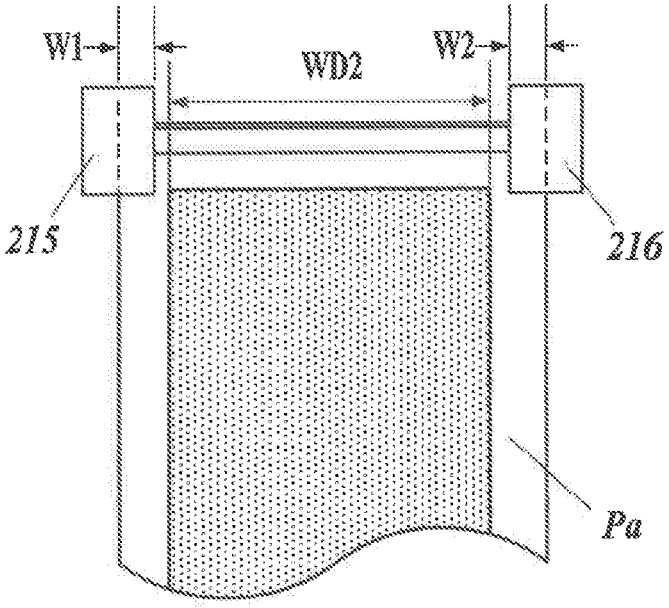
FIG. 3B This is a view for explaining the positional relationship between a recording medium and the first end pressing roller and the second end pressing roller.

FIGS. 3A and 3B are views for explaining the positional relationship between the recording medium P and the first end pressing roller 215 and the second end pressing roller 216.

As shown in FIG. 3A, when seen from above the recording surface of recording medium P, the first end pressing roller 215 and the second end pressing roller 216 respectively press the ends which are different in the width direction of the recording medium P in ranges not overlapping the recording width range WD1 of the image in the width direction of the recoding medium P. Each of the width W1 for which the first end pressing roller 215 overlaps the recording medium P and the width W2 for which the second end pressing roller 216 overlaps the recording medium P can be determined to be, for example, 1 cm as the fixed width according to the ink jet recording apparatus 1.

As shown in FIG. 3B, in a case where the size (width) of the recording medium was changed, the position of at least one of the first end pressing roller 215 and the second end pressing roller 216 is moved so that the recording medium Pa is pressed to the positions located on the inner sides for the widths W1 and W2 from the both end positions in the width direction which are set according to the changed recording medium Pa, and the recording medium P is pressed within the ranges not overlapping the recording width range WD2 of the image.

Figure 4:
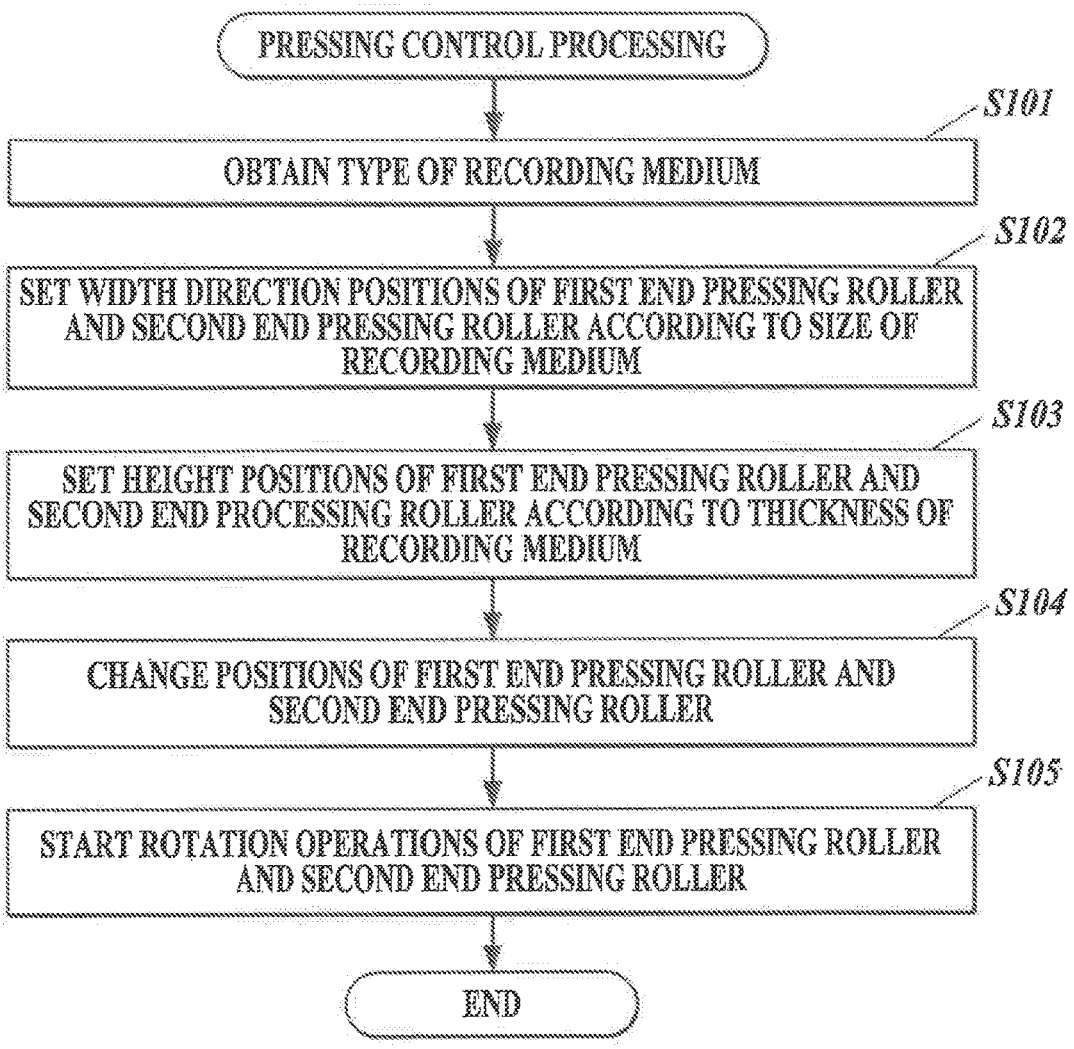
FIG. 4 This is a flowchart showing a control procedure by a conveyance controller regarding the operation of a second pressing motor in the ink jet recording apparatus.

FIG. 4 is a flowchart showing the control procedure by the conveyance controller 411 for the operation of the second pressing motor 217 in the ink jet recording apparatus 1.

As described above, the pressing control processing is started when the type setting of the recording medium P is obtained by input of the print job or the input operation via the operation display 31 by the user.

When the pressing control processing is started, the conveyance controller 411 (CPU) obtains the type of the recording medium after the change (step S101). The conveyance controller 411 sets the positions in the width direction of the first end pressing roller 215 and the second end pressing roller 216 outside the recording width range according to the size of the recording medium P (step S102). The conveyance controller 411 sets the height positions of the first end pressing roller 215 and the second end pressing roller 216 according to the thickness information of the recording medium P (step S103).

The conveyance controller 411 outputs the control signal to the second conveyance motor 218 to change the positions of the first end pressing roller 215 and the second end pressing roller 216 (step S104). The conveyance controller 411 outputs the control signal to the second conveyance motor 218 on the basis of the timing to start the image recording on the recording medium P, to start the operation so that the first end pressing roller 215 and the second end pressing roller 216 rotate at appropriate rotation speeds (step S105). Then, the conveyance controller 411 ends the pressing control processing.

As described above, the ink jet recording apparatus 1 in the embodiment includes: an image former 12 that is provided with nozzles for ejecting ink; a first conveyer 11 that conveys the recording medium P, on which the ejected ink is to land, to move the recording medium P relative to the image former 12; a fixer 24 that fixes the ink which landed on the recording medium P onto the recording medium P; a second conveyer 21 that conveys the recording medium P on which the ink to be fixed landed, to move the recording medium P relative to the fixer 24; and a first end pressing roller 215, a second end pressing roller 216 and a second pressing motor 217 as a floating suppresser which suppresses, from the ink-landed surface side, floating of the recording medium P from the conveyance surface on which the recording medium P is placed in the second conveyer 21. The floating suppresser suppresses floating of the recording medium P in the suppression ranges (W1 and W2) which can be changed and set not to include the recording width range in which the image former 12 causes the ink to land on the recording medium P in the width direction orthogonal to the conveyance direction of the recording medium P by the second conveyer 21 in the conveyance surface.

In this way, since the first end pressing roller 215 and the second end pressing roller 216 prevent the floating of the recording medium P at the positions not including the recording width range where the ink is not ejected onto the recording medium P, that is, both ends, it is possible to prevent non-uniform conveyance state due to the curvature of the recording medium P or the like by a simple configuration, and cause the fixer 24 to uniformly perform the fixing operation. Since the first end pressing roller 215 and the second end pressing roller 216 do not contact the recording width range of the recording medium P after image recording, the unfixed ink is not disturbed and the image quality is not deteriorated. In addition, since the positions of the first end pressing roller 215 and the second end pressing roller 216 can be appropriately adjusted according to the size of the recording medium P, the same effect can be easily obtained also for the recording medium of a different size. Since the image recording operation and the fixing operation are performed by different conveyers, the temperature rise due to the fixing operation does not have bad influence on the image recording operation.

Since there is also provided a second sucker 214 that causes the recording medium P, for which the floating from the conveyance surface is suppressed, to adhere to the conveyance surface of the second conveyer 21 by suction, the recording medium P for which floating is suppressed can be more surely sucked to be fixed onto the conveyance surface, and thus, uniform fixing processing can be more surely performed.

Since the floating suppresser is provided in such a manner that at least a part of each of the suppression ranges is included between the suction start position by the second sucker 214 and the fixing start position by the fixer 24 in the conveyance direction, the sucking adhesion operation can be started while the floating of the recording medium P is surely suppressed. Thus, by once suppressing the floating of the recording medium P at the head, it is possible to thereafter maintain the state of fixed placement on the conveyance surface easily and surely in the sucking adhesion range.

There is also included a pressing controller 412 as a suppression controller which controls the setting of the suppression ranges by the floating suppresser, and the second conveyer 21 conveys the recording medium P by placing the recording medium P at a position corresponding to the size in the width direction of the recording medium P, and the pressing controller 412 determines the suppression ranges not to include the recording width range. In this way, since the suppression ranges are automatically set at appropriate positions according to the size when the size of the recording medium P is specified, it is possible to automatically set the suppression ranges according to the size of the recording medium more easily and surely.

There is also included an operation display 31 (operation detector 311) which receives user operation, and the operation display 31 can receive the setting of the size in the width direction. Accordingly, analysis by reading the setting of the print job or the like is not performed, and even without such a setting in the print job, the floating of the recording medium P is surely suppressed by the first end pressing roller 215 and the second end pressing roller 216 in appropriate suppression ranges according to the setting in a case where the user directly sets the appropriate size.

The floating suppresser presses the recording medium P against the conveyance surface. Accordingly, it is not necessary to maintain the first end pressing roller 215 and the second end pressing roller 216 at subtle heights, and it is possible to completely eliminate the floating of the recording medium P. Especially, in an image recording apparatus or the like which performs post-processing of cutting off the ends on which image recording was not performed, no problem occurs even when some hurts or dirties are generated on the recording medium P in such suppression ranges.

The floating suppresser has roller members provided to be rotatable around a rotation shaft which is parallel to the width direction. Accordingly, since the roller members rotate in accordance with the conveyance speed of the recording medium P, the floating is surely eliminated in the suppression ranges, and at the same time, hurts and the like are not easily generated in the suppression ranges. In addition, since the friction between the roller members and the recording medium P is reduced, it is possible to more reduce the generation of problems such as misalignment or a jam of the recording medium P.

The image former 12 ejects an ink of UV curable type, and the fixer 24 has an LED which emits UV light to the UV curable ink which landed on the recording medium P.

Accordingly, ink is fixed very firmly. Since the reaction heat due to the ink fixing does not transmit to the recording medium P on the first conveyer 11, bad influence is not generated at the time of image recording.

There is provided a conveyer heater 110 which maintains the temperature of the conveyance surface of the first conveyer 11 within a predetermined temperature range. As described above, since the operation of the fixer 24 is performed to the recording medium P on the second conveyer 21, the temperature control of the conveyer heater 110 is easy. Especially, in accordance with increase in the conveyance surface temperature, complicated control which is performed differently between heating and cooling is not necessary, and the power consumption by cooling for appropriately suppressing the excess temperature rise is not increased. In the cooling operation by the cooler 25 on the second conveyer 21 side, the temperature control is easy since control for raising temperature is not necessary and temperature management also does not need to be strict compared to the time of image recording.

There is also provided a reader 13 which reads the landing surface of the recording medium on which ink landed on the conveyance surface of the first conveyer 11. In this way, by performing the reading operation before delivery of the recording medium P to the second conveyer 21, it becomes easier to perform accurate determination and processing of the reading position.

MODIFICATION EXAMPLES

Next, modification examples of the second conveyer 21 in the ink jet recording apparatus 1 in the embodiment will be described.

Figure 5A:
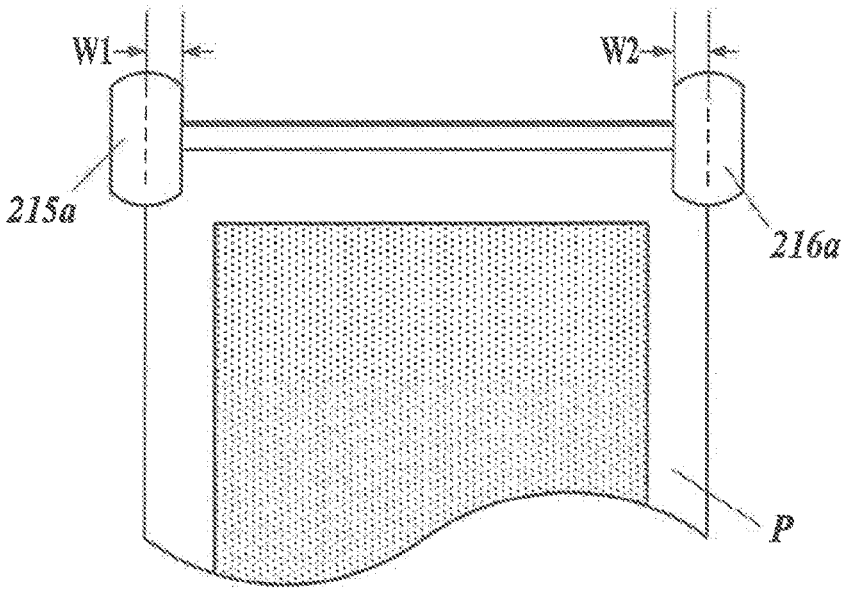
FIG. 5A This is a view for explaining a modification example 1 of a second conveyer.
Figure 5B:
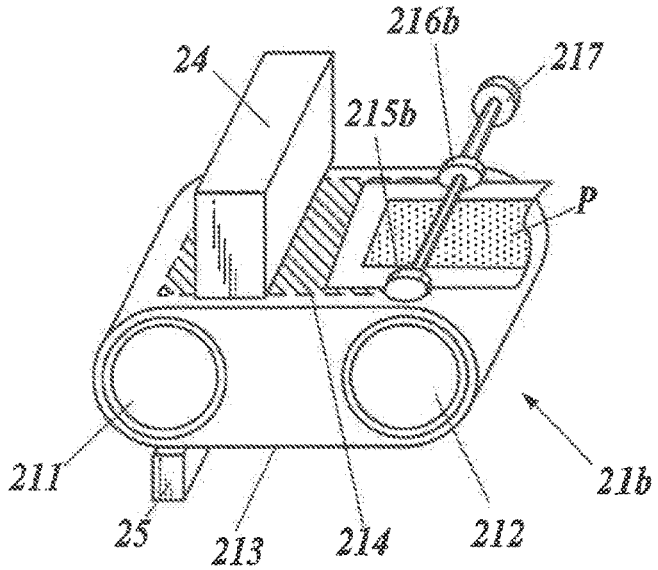
FIG. 5B This is a view for explaining a modification example 2 of a second conveyer.

FIGS. 5A and 5B are views for explaining modification examples of the second conveyer 21.

FIG. 5A is a view showing a first end pressing roller 215*a* and a second end pressing roller 216*a* in a modification example 1 of the second conveyer 21.

In the second conveyer 21 in the modification example 1, the first end pressing roller 215*a* and the second end pressing roller 216*a* are crown rollers (drum rollers) in each of which the rotation radius varies according to the position in the width direction. That is, on the ends closer to the center of the recording medium P in the width direction, the rotation radius is small compared to the respective central positions in the width direction of the first end pressing rollers 215*a* and the second end pressing roller 216*a*.

Thus, except for a case where the recording medium P largely floats from the outer lateral surface (conveyance surface) of the second conveyance belt 213 to cause insufficient adhesion by suction of the second sucker 214, the first end pressing roller 215*a* and the second end pressing roller 216*a* do not strongly press the recording medium P, and furthermore, in a case where the floating of the recording medium P is sufficiently small or there is no floating, it is possible to avoid contact of the first end pressing roller 215*a* and the second end pressing roller 216*a* with the recording medium P.

FIG. 5B is a perspective view showing the outer appearance of a second conveyer 21*b* in a modification example 2.

The second conveyer 21*b* is provided with a first end presser 215*b* and a second end presser 216*b* which do not rotate, instead of the first end pressing roller 215 and the second end pressing roller 216. The other configurations are similar to those of the second conveyer 21 in the embodiment, and the explanation is omitted by providing same reference numerals.

Here, the second pressing motor 217 causes the first end presser 215*b* and the second end presser 216*b* to move in the vertical direction and the width direction, whereas the second pressing motor 217 does not cause the first end presser 215*b* and the second end presser 216*b* to rotate. Accordingly, the conveyed recording medium P is guided along the curved surfaces in the convex surface shapes on the upstream side in the moving direction of the first end presser 215*b* and the second end presser 216*b* so as to be along the outer lateral surface of the second conveyance belt 213, and the recording medium P firmly adheres to the outer lateral surface by suction by the second sucker 214 and passes while contacting or without contacting the lower surfaces of the first end presser 215*b* and the second end presser 216*b*.

Figure 6A:
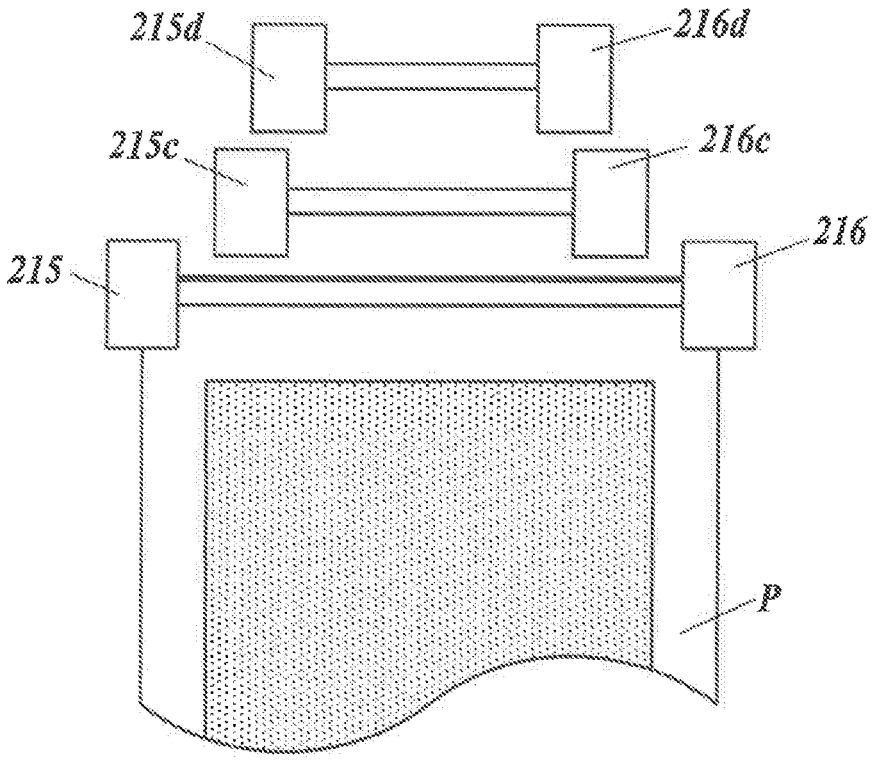
FIG. 6A This is a view showing a second conveyer in a modification example 3.
Figure 6B:
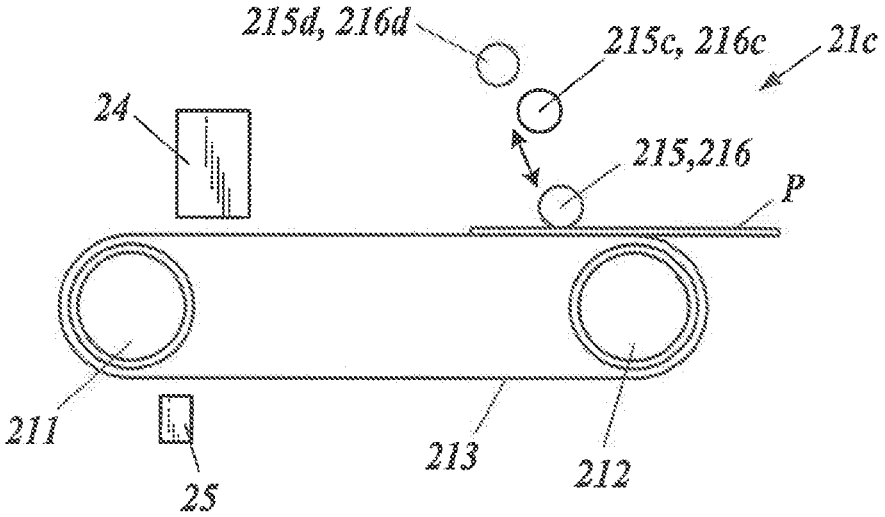
FIG. 6B This is a view showing the second conveyer in the modification example 3.

FIGS. 6A and 6B are views showing a second conveyer 21*c* in a modification example 3. FIG. 6A is a plan view seen from above the surface of the recording medium P placed on the second conveyance belt 213, the surface being opposite to the contact surface with the second conveyance belt 213, and FIG. 6B is a front view seen from the direction extending the rotation shaft of the second drive roller 211.

The second conveyer 21*c* in the modification example 3 is provided with a medium-width first end pressing roller 215*c*, a medium-width second end pressing roller 216*c*, a small-width first end pressing roller 215*d* and a small-width second end pressing roller 216*d* in addition to the first end pressing roller 215 and the second end pressing roller 216 in the embodiment (hereinafter, also collectively referred to as end pressing rollers 215 to 215*d*, 216 to 216*d* or the like). Since the other configurations are similar to those of the embodiment, the explanation is omitted by providing same reference numerals to the same configurations.

The interval between first end pressing roller 215 and the second end pressing roller 216 in the modification example 3 is fixed according to the width of the recording medium P of a predetermined size (large width size). The interval between the medium-width first end pressing roller 215*c* and the medium-width second end pressing roller 216*c* is fixed according to a width (medium width size) of the recording medium P having a width which is smaller than the above-mentioned large width size. The interval between the small-width first end pressing roller 215*d* and the small-width second end pressing roller 216*d* is fixed according to a predetermined width (small width size) of the recording medium P which is smaller than the medium width size.

The second pressing motor 217 performs switching arrangement so that any one of a pair of the first end pressing roller 215 and the second end pressing roller 216, a pair of the medium-width first end pressing roller 215*c* and the medium-width second end pressing roller 216*c* and a pair of the small-width first end pressing roller 215*d* and the small-width second end pressing roller 216*d* presses the recording medium P against the outer lateral surface of the second conveyance belt 213. That is, among the end pressing rollers 215 to 215*d* and 216 to 216*d*, the second pressing motor 217 selectively causes the pair corresponding to the width of the recording medium which was set to press both ends of the recording medium P, and causes the other pairs to retreat. Though the retreat positions are above the recording medium Pin FIG. 6B, the other pairs may also be movable in the width direction and the conveyance direction according to the space.

As described above, in the ink jet recording apparatus 1 having the second conveyer 21*c* in the modification example 3, the floating suppresser has a plurality of different end pressing rollers 215 to 215*d* and 216 to 216*d* which suppress the floating of the recording medium Pin the suppression ranges according to predetermined sizes in the width direction (here, large width size, medium width size and small width size), the number of the end pressing rollers corresponding to the sizes in the width direction, and the pressing controller 412 selectively arranges the end pressing rollers corresponding to the obtained size in the width direction at positions corresponding to the suppression ranges, to suppress the floating of the recording medium P.

Accordingly, it is not necessary to perform fine adjustment of the positions in the width direction of the end pressing rollers, the user merely simply needs to vertically move the end pressing rollers of the pair corresponding to each size in the width direction, and thus, the drive operation and the control operation become further easier.

The present invention is not limited to the above embodiments, and various changes can be made.

For example, though the second pressing motor 217 performs operation of moving the positions in the width direction of the first end pressing roller 215 and the second end pressing roller 216 in the embodiments, the rollers may be manually movable by the user. In this case, there may be provided scales, marks or the like at the setting positions corresponding to the sizes of the recording medium.

Though conveyance is performed by using the endless belt in the embodiments, the conveyance may be performed by placing the recording medium on the outer circumferential surface of the rotating drum.

Though the embodiments have been described by taking, as an example, emission of UV light as the ink fixing operation, visible light or other energy rays may be emitted, or in a case of an ink which is a type fixed by drying, the fixer may have a heating mechanism of blowing warm air or the like.

Though the recording medium P is pressed for a width which is determined according to the size of the recording medium P at the two positions on both ends in the width direction of the recording medium P in the embodiments, in a case where the margin is set in the print job, the width for pressing may be changed according to the margin. In a case of segmentation printing or the like, the pressing rollers may be arranged at the center in the width direction on which ink will not land. The suppression ranges may not be determined across both ends in the width direction of the recording medium P. For example, the suppression ranges may be determined on sides which are located a little inner than the ends in the width direction. In a case where the curve direction of the recording medium or the like is determined, there is possibly preferably set, as the suppression range, the position enabling effective suppression of the floating within the range not including the recording width range.

Each of the suppression ranges which are set in a predetermined range in the width direction may be longer in the conveyance direction than that of the embodiments, or may be set at a plurality of positions separated in the conveyance direction. In a case where the suppression ranges are set to be sufficiently long in the conveyance direction, smoothness of the recording medium P can be maintained and uniform fixing operation can be performed even when the second sucker is not necessarily provided.

Though the recording medium P is delivered to the second conveyer 21 via the deliverer 30 from the first conveyer 11 in the embodiments, the recording medium P may be directly delivered, or may be delivered via another configuration. In both of the cases, until the fixing operation is performed after the landing of ink on the recording medium P, the delivery is performed in such a manner that the configuration in the ink jet recording apparatus 100 does not contact the ink-landed surface.

Though the positions of the first end pressing roller 215 and the second end pressing roller 216 are fixed in consideration of the thickness of the recording medium P in the embodiments, in a case where the thickness of the recording medium of the image recording target does not vary largely, the positions may be steady positions without consideration of the thickness. The first end pressing roller 215 and the second end pressing roller 216 may be arranged to be vertically movable according to the bounce or the like of the recording medium P. In this case, the first end pressing roller 215, the second end pressing roller 216, a shaft supporting the rollers and the like are set to have weights of such degrees as enabling effective suppression of floating due to the curvature or the like of the recording medium P by the downward force caused by their own weights.

The other specific details such as the components, configurations, arrangements and operation contents shown in the embodiments can be appropriately modified within the scope of the present invention.

INDUSTRIAL APPLICABILITY

The present invention is applicable to ink jet recording apparatuses.

EXPLANATION OF REFERENCE NUMERALS

1 ink jet recording apparatus
11 first conveyer
110 conveyer heater
111 first drive roller
112 first following roller
113 first conveyance belt
114 first sucker
115 pressing roller
117 first pressing motor
118 first conveyance motor
119 conveyance surface temperature measure
12 image former
12C, 12M, 12Y and 12K head units
121 head driver
122 ink temperature measure
123 ink heater
13 reader
21 second conveyer
21*b* second conveyer
21*c* second conveyer
211 second drive roller
212 second following roller
213 second conveyance belt
214 second sucker
215 first end pressing roller
215*a* first end pressing roller
215*b* first end presser
215*c* medium-width first end pressing roller
215*d* small-width first end pressing roller
216 second end pressing roller
216*a* second end pressing roller
216*b* second end presser
216*c* medium-width second end pressing roller
216*d* small-width second end pressing roller
217 second pressing motor
218 second conveyance motor
22 fixer

25 cooler
251 cooling fan driver
deliverer
31 operation display
311 operation detector
312 display
32 communicator
40 controller
401 CPU
402 RAM
403 storage
403*a* program
411 conveyance controller
412 pressing controller
413 conveyer heating controller
414 suction controller
421 head controller
422 ink heating controller
43 reading controller
44 fixing controller
45 cooling controller
P recording medium
Pa recording medium

The invention claimed is:

1. An ink jet recording apparatus, comprising:

an image recorder that is provided with a nozzle which ejects ink;

a first conveyer that conveys a recording medium, on which the ejected ink is to land, to move the recording medium relative to the image recorder;

a fixer that fixes the ink which lands on the recording medium onto the recording medium;

a second conveyer that conveys the recording medium, on which the ink to be fixed lands, to move the recording medium relative to the fixer; and a floating suppresser that suppresses, from an ink-landed surface side, floating of the recording medium from a conveyance surface on which the recording medium is placed in the second conveyer, wherein the floating suppresser suppresses the floating of the recording medium in a suppression range that is able to be changed and set not to include a recording width range in a width direction orthogonal to a conveyance direction of the recording medium by the second conveyer in the conveyance surface, the recording width range being a range in which the image recorder causes the ink to land on the recording medium, and the floating suppresser includes first and second suppressers that suppress the floating at respective ends of the recording medium in the width direction, and positions of the first and second suppressers in the width direction are able to be changed and set independently or in conjunction with each other.

2. The ink jet recording apparatus according to claim 1, further comprising a sucker that causes the recording medium, for which the floating from the conveyance surface is suppressed, to adhere to the conveyance surface of the second conveyer by suction.

3. The ink jet recording apparatus according to claim 2, wherein the floating suppresser is provided in such a manner that at least a part of each of the suppression range is included between a suction start position by the sucker and a fixing start position by the fixer in the conveyance direction.

4. The ink jet recording apparatus according to claim 1, further comprising a hardware processor that controls setting of the suppression range by the floating suppresser, wherein the second conveyer conveys the recording medium by placing the recording medium at a position corresponding to a size in the width direction of the recording medium, and the hardware processor determines the suppression range not to include the recording width range.

5. The ink jet recording apparatus according to claim 4, further comprising an operation receiver that receives user operation, wherein the operation receiver is able to receive setting of the size in the width direction.

6. The ink jet recording apparatus according to claim 1, wherein the first and second suppressers press the recording medium against the conveyance surface.

7. The ink jet recording apparatus according to claim 6, wherein the first and second suppressers have rollers that are provided to be rotatable around a rotation shaft which is parallel to the width direction.

8. The ink jet recording apparatus according to claim 1, wherein the image recorder ejects ink to be hardened by predetermined energy rays, and the fixer has an emitter that emits the predetermined energy rays to the ink which lands on the recording medium.

9. The ink jet recording apparatus according to claim 1, further comprising a temperature adjuster that maintains a temperature of a conveyance surface of the first conveyer within a predetermined temperature range.

10. The ink jet recording apparatus according to claim 1, further comprising a reader that reads a landing surface of the recording medium on which the ink lands on a conveyance surface of the first conveyer.

11. The ink jet recording apparatus according to claim 1, wherein the first suppresser comprises a first roller, the second suppresser comprises a second roller, and the first and second rollers are coaxially coupled with a rotation shaft.

12. The ink jet recording apparatus according to claim 1, wherein the first and second suppressers press the respective ends of the recording medium so that the ends are in contact with the conveyance surface.

* * * * *